United States Patent [19]

Frederick

[11] Patent Number: 4,508,474

[45] Date of Patent: Apr. 2, 1985

[54] AIR CONVEYOR FOR PARTICULATE MATERIAL

[76] Inventor: Charles V. Frederick, Rte. #5, New Virginia, Iowa 50219

[21] Appl. No.: 459,717

[22] Filed: Jan. 21, 1983

[51] Int. Cl.[3] ..... B65G 53/16

[52] U.S. Cl. ..... 406/88; 406/137

[58] Field of Search ..... 406/86, 88, 89, 90, 406/93–95, 137

[56] References Cited

U.S. PATENT DOCUMENTS 1,844,635 2/1932 Caller ..... 406/88

2,882,097 4/1959 Hamren ..... 406/89 X 4,123,114 10/1978 Rataj et al. ..... 406/86

*Primary Examiner*—Jeffrey V. Nase

*Attorney, Agent, or Firm*—Zarley, McKee, Thomte, Voorhees & Sease

[57] ABSTRACT

A conveyor for particulate material consists of a plurality of channel shaped air deflectors mounted in overlapping engagement on support beams. Each air deflector has a short lower flange, a longer upper flange and an interconnecting web. Protrusions on the bottom side of the upper flange maintains a gap between upper flanges of adjacent air deflectors. Air is forced through the gap between adjacent air deflectors so as to convey particulate material over the upper flanges thereof.

4 Claims, 5 Drawing Figures

AIR CONVEYOR FOR PARTICULATE MATERIAL

BACKGROUND OF THE INVENTION

Conventional storage buildings for particulate matter rely on moving conveyor systems for transporting the material out of the building. These conveyors have moving parts which are subject to wear and tear and require maintenance to keep them working properly. Also, such conveyors with moving parts may bind and be subject to breakdowns when the particulate material becomes jammed in the moving parts.

Therefore, it is a primary objective of the present invention to provide an air conveyor for particulate material that is not subject to wear and tear and requires very little maintenance.

It is a further objective of the present invention to provide an air conveyor for particulate material that has no moving parts.

It is a further objective of the present invention to provide an air conveyor for particulate material that utilizes air flow to move the material.

It is a further objective of the present invention to provide an air conveyor for particulate matter that is economical to construct and easy to install.

SUMMARY OF THE INVENTION

The present invention comprises an air conveyor for moving particulate material. The conveyor may be enclosed in a particulate material storage building having side walls, a roof and an inclined floor. The conveyor is comprised of a plurality of air deflectors mounted on I-beams inclined towards the periphery of the building.

The air deflectors are constructed from sheet metal and have a lower flange adapted to be secured to the I-beams, a longer upper flange and an interconnecting web. The upper flange of one air deflector rests upon the upper flange of the next lower adjacent air deflector. Small protrusions on the lower side of the upper flange maintain a gap between the upper flanges of adjacent air deflectors. Air from a pressurized air space located beneath the floor is forced upwardly through the air deflectors and out through the gap such that the particulate matter is blown downwardly towards a gate which permits the material to be removed from the building.

DETAILED DESCRIPTION OF THE DRAWINGS

Figure 1:
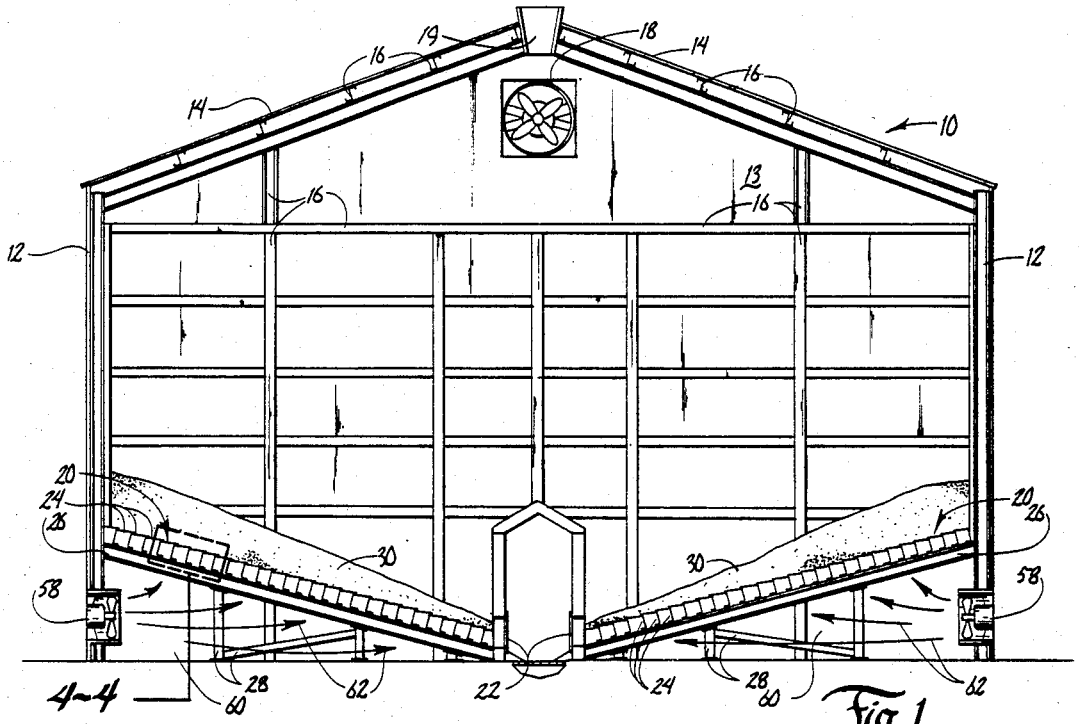
FIG. 1 is a sectional elevation view of the particulate material storage building.

In FIG. 1 the numeral 10 generally designates a building for storing particulate material. Building 10 has side walls 12, a back wall 13, a front wall (not shown), a roof 14, structural support members 16 and a ventilation fan 18. Any conventional means is used for transporting the particulate material into the building such as through opening 19 in roof 14.

The air conveyor of the present invention is used as a means for removing grain from the building 10 when the building is nearly empty and there is an insufficient amount of grain for the grain to flow by gravity through conventional gates 22. The numeral 20 generally designates the conveyor which also doubles as a support floor for grain. Conveyor 20 is comprised of a plurality of air deflectors 24 mounted upon inclined beams 26 supported by structural members 28. The numeral 30 represents the particulate material in building 10. Any conventional means may be used for depositing material 30 into building 10.

Figure 2:
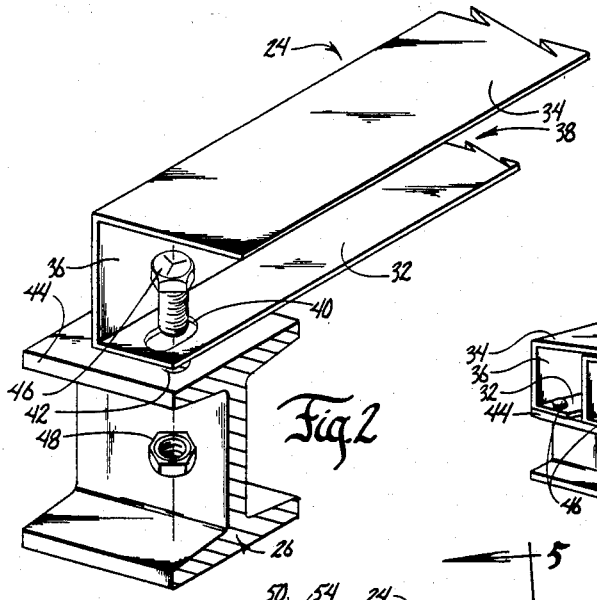
FIG. 2 is a partial exploded perspective view of one air deflector and an I-beam.
Figure 3:
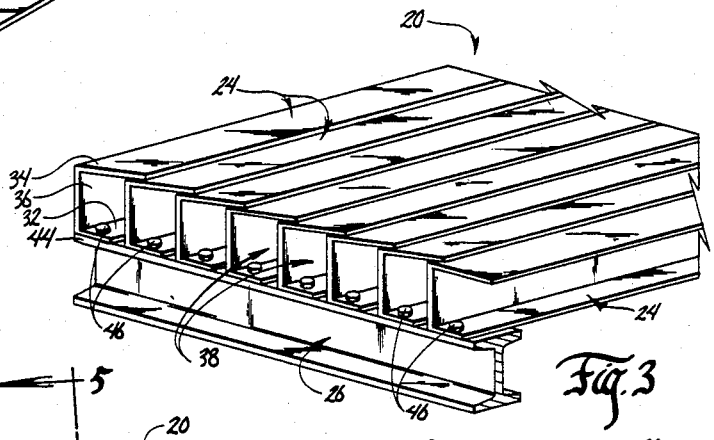
FIG. 3 is a partial perspective view of a plurality of air deflectors as positioned on the I-beams.

Referring to FIG. 2, each air deflector is constructed from sheet metal material and comprises a lower flange 32, a longer upper flange 34 and a web 36 that interconnects flanges 32 and 34 so as to form a channel portion 38. Lower flange 32 has a slot 40 through it that aligns with a corresponding hole 42 in the upper flange 44 of I-beam 26 such that a bolt 46 may pass through slot 44 and hole 42 to receive a nut 48 for securing air deflector 24 to I-beam 26.

Upper flange 34 of air deflector 24 has a forward edge 50 and a rearward edge 52. On the underneath side of forward edge 50 are a plurality of protrusions 54.

When air deflectors 24 are secured in place on I-beam 26, the forward edge 50 of upper flange 34 overlaps the rearward edge 52 of upper flange 34 of the next lower adjacent air deflector 24. The protrusions 54 maintain a gap 56 between forward edge 50 and rearward edge 52 of the adjacent upper flanges.

Figure 4:
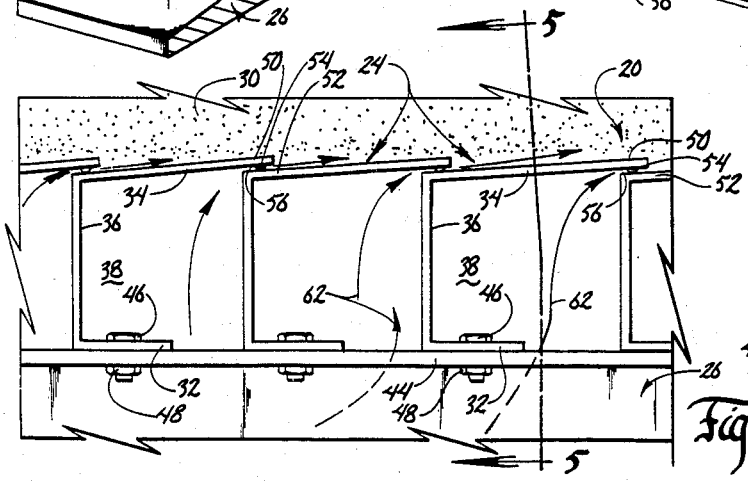
FIG. 4 is an end elevation view of a plurality of air deflectors taken along line 4—4 of FIG. 1.
Figure 5:
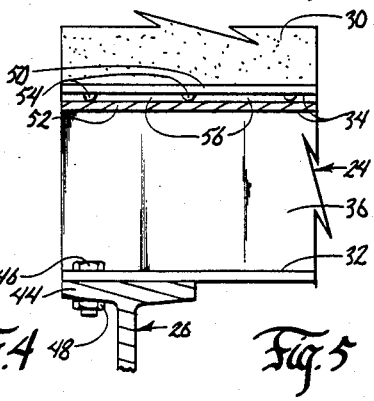
FIG. 5 is a partial front elevation view showing the gap between two adjacent air deflectors taken along line 5—5 of FIG. 4.

In operation, fans 58 in walls 12 of building 10 force air into the air space 60 located beneath conveyor 20. Other conventional means may be used to pressurize air space 60. Air is forced upwardly between adjacent air deflectors and outwardly through gap 56 between forward edge 50 of one air deflector and rearward edge 52 of the next lower adjacent air deflector, as indicated by arrows 62 in FIG. 4. The air thus passes over the tops of upper flanges 34 so as to convey the particulate material downwardly towards gates 22 for removal from the building.

It is understood that the conveyor could be used as a conveyor per se and not as a floor structure within a building without departing from the present invention.

It can therefore be seen that the present invention accomplishes at least all of its stated objectives.

What is claimed is:

1. An air conveyor for particulate material comprising: elongated parallel conveyor support members, a plurality of channel shaped air deflectors mounted in juxtaposition on said support members, each of said air deflectors being in overlapping engagement with the next adjacent air deflector, each of said air deflectors having a short lower flange adapted to be secured to said support members, an upper flange generally parallel to and extending further in the same direction as said lower flange, and a web integrally interconnecting said upper and lower flanges to form a channel.

2. The conveyor of claim 1 wherein said upper flange of each of said air deflectors has a top side, a bottom side, a forward edge and a rearward edge, said rearward edge being integrally connected to said web, and said bottom side of said forward edge having a plurality of protrusions.

3. The conveyor of claim 2 wherein said forward edge of said upper flange of each of said air deflectors extends over said rearward edge of said upper flange of the next lower adjacent air deflector, said protrusions of the upper adjacent air deflector contacting said top side of said upper flange of said lower adjacent air deflector thereby maintaining an opening between said bottom side of said upper flange of said upper air deflector and said top side of said upper flange of said lower adjacent air deflector.

4. The conveyor of claim 3 wherein air from an air forcing means is forced through said opening between adjacent air deflectors thereby blowing the particulate material over said top sides of said upper flanges of said air deflectors.

* * * * *